US006869316B2

(12) United States Patent
Hinkle et al.

(10) Patent No.: US 6,869,316 B2
(45) Date of Patent: Mar. 22, 2005

(54) THREE CONTACT BARREL POWER CONNECTOR ASSEMBLY

(75) Inventors: Mark M. Hinkle, Austin, TX (US); Christopher H. Muenzer, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/185,106

(22) Filed: Jun. 27, 2002

(65) Prior Publication Data

US 2004/0002266 A1 Jan. 1, 2004

(51) Int. Cl.[7] ..... H01R 33/20
(52) U.S. Cl. ..... 439/675; 439/63; 439/578
(58) Field of Search ..... 439/675, 63, 394, 439/578, 625–626, 660; 385/76–77

(56) References Cited

U.S. PATENT DOCUMENTS 4,453,796 A * 6/1984 Monroe ..... 439/581
4,545,633 A * 10/1985 McGeary ..... 439/141
5,082,345 A 1/1992 Cammons et al. ..... 385/60
5,085,594 A 2/1992 Kaelin ..... 439/427
5,147,221 A * 9/1992 Cull et al. ..... 439/585
5,681,186 A * 10/1997 Wright ..... 439/675
5,683,265 A 11/1997 Allen et al. ..... 439/394
5,807,131 A 9/1998 Allen et al. ..... 439/394
5,915,995 A * 6/1999 Meyer et al. ..... 439/668
6,196,731 B1 3/2001 Carlisle et al. ..... 385/76
6,318,903 B1 11/2001 Andrews et al. ..... 385/77
6,507,998 B1 * 1/2003 Lyford et al. ..... 29/843
6,676,451 B2 * 1/2004 Suzuki et al. ..... 439/668

* cited by examiner

*Primary Examiner*—Michael C. Zarroli
(74) *Attorney, Agent, or Firm*—Baker Botts L.L.P.

(57) ABSTRACT

A three contact barrel power connector assembly is provided. The power connector assembly includes both a connector plug and a connector jack. The connector plug includes an inner body and an outer body transmitting electrical current. The connector plug further includes a center body that transmits a data signal or a low power current. The connector jack includes a housing ground, a housing body, outer contacts that couple with the outer body, inner contacts that couple with the inner body, and a center contact that couples with the center body. The power connector assembly further includes insulators operable to prevent unwanted electrical contact between the connector plug and the connector jack. The connector plug is operable to couple with the connector jack independent of the orientation of the connector plug with respect to the connector jack, provide high levels of power, and effectively transmit data signals in addition to power.

17 Claims, 4 Drawing Sheets

THREE CONTACT BARREL POWER CONNECTOR ASSEMBLY

TECHNICAL FIELD

This disclosure relates in general to the field of power and data transmission, and more particularly to a three contact barrel power connector assembly.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

The transmission of power and data to an information handling system is important especially with respect to portable devices such as laptop computers and personal digital assistants (PDA) that are designed to operate on both battery power and power supplied by a wall outlet. As portable devices have become more advanced and able to perform more functions, the portable devices require more power to operate. Because batteries only last for a finite time before requiring a new charge, many portable devices may also be able to plug into a wall outlet and run on AC power. But since portable devices primarily operate on battery power (DC power), an AC adapter is required when powering a portable device from a wall outlet to convert the AC power to DC power. Generally, a portable device includes an electrical cable or power cord where one end of the electrical cable plugs into the AC adapter and the other end of the electrical cable has a plug that plugs into a jack on the portable device where the jack and plug together are a power connector for the transmission of power.

One limitation with current power connectors is that the plug must be orientated in a specific way in order for the plug to mate with the jack. For example, the plug may have an asymmetrical shape and only mate with the jack when the plug is oriented in a specific manner and will not mate with the jack when the plug is not oriented in that manner. This cause problems for a user when the user is attempting to insert the plug into the jack when the user does not have a clear line of sight to the jack or when the user cannot easily reach the jack. The user must try to guess as to the correct orientation of the plug and rotate the plug until the plug is in the correct orientation as the jack, which can be a bothersome task if the user cannot see the jack or has to strain to reach the jack.

Another limitation with current power connectors is the inability to safely transmit high levels of power to the information handling system. As processor speeds and memory requirements continue to increase, portable devices require more power to efficiently function and therefore have higher power requirements. In order to transmit higher power levels, current power connectors require increasing the wire diameter of the power cord to dissipate the heat generated by the higher power levels as well as increasing the overmold on the plug which acts as a heatsink to prevent the melting of the power cord and the power connector. This results in thicker, bulkier, more expensive, and less portable power connectors and power cords which increases the cost and creates a portability problem where a smaller size allows for optimal portability.

Another limitation with current power connectors is the inability to effectively transmit a data signal in addition to power. In addition to power from the wall outlet and AC adapter, portable devices may also be need to receive data information from the AC adapter regarding the operation and type of the AC adapter. The power connector may also need to receive data information from other attached components to optimize the functionality of the portable device.

SUMMARY

Therefore, a need has arisen for a power connector assembly that allows for the orientationless mating of a connector plug with a connector jack.

A further need has arisen for a power connector assembly that allows for the transmission of high power levels.

A further need has arisen for a power connector assembly that allows for the transmission of a data signal in addition to the transmission of power.

In accordance with the teachings of the present disclosure, a power connector assembly including a connector plug assembly and a connector jack assembly is described which substantially eliminates or reduces disadvantages and problems associated with previous power connectors. The power connector assembly allows for the orientationless mating of a connector plug with a connector jack and the transmission of both high power levels and a data signal.

In accordance with one aspect of the present disclosure, an orientationless connector plug assembly is provided. The connector plug assembly preferably includes an outer body, an inner body, a center body, and one or more insulators. The outer body is of a cylindrical shape and transmits an electrical current. The inner body is also of cylindrical shape, transmits an electrical current, and is coaxially secured in alignment with the outer body. The center body is disposed coaxially within the outer and inner bodies and transmits a data signal and may alternatively transmit a low power current. The insulators are disposed coaxially with the outer, inner, and center bodies and prevent electrical contact between the outer body, inner body, and center body. The connector plug operably couples with a connector jack independent of the orientation of the connector plug with respect to the orientation of the connector jack.

In one embodiment, the connector plug assembly includes an outer barrel, an inner barrel, and a center pin. The outer and inner barrels transmit the electrical current for DC power while the center pin transmits a data signal. An insulating barrel prevents the transmission of electrical current between the outer barrel and the inner barrel while an insulating tip prevents the transmission of electrical current and data between the connector plug assembly and the connector jack assembly except for at a plurality of contacts on the connector jack assembly.

In another aspect of the present disclosure, an orientationless connector jack assembly is provided. The connector jack assembly preferably includes a connector housing that provides grounding for the connector jack assembly. Disposed within the connector housing is a connector body providing insulation, having a shape operable for mating with the connector plug assembly, and includes a mating aperture and plurality of contact apertures. The connector plug assembly further includes at least one outer contact to receive and transmit electrical current, at least one inner contact to receive and transmit electrical current, and a center contact operable to receive and transmit a data signal or alternatively a low power current. The outer, inner, and center contacts are each disposed in a contact aperture and extend out into the mating aperture. The connector jack assembly receives the connector plug assembly independent of the orientation of the connector plug.

In one embodiment, the connector jack includes four outer contact, four inner contacts, and a center contact. The four outer contacts couple with the outer body of the connector plug, the four inner contacts couple with the inner body of the connector plug, and the center contact couples with the center body of the connector plug. The coupling of the outer, inner, and center bodies of the connector plug with the outer, inner, and center contacts of the connector jack allows for the transmission of electrical current and a data signal.

In another aspect of the present disclosure, an information handling system having a barrel connector plug and a connector jack is provided. The barrel connector plug transmits both a data signal and an electrical current and includes an outer body, an inner body, and a center body. The connector jack includes a connector housing and a plurality of contacts and is operable to mate with the barrel connector plug independent of the orientation of the barrel connector plug. The connector jack further receives and transmits an electrical current and data signal from the barrel connector plug.

The present disclosure provides a number of important technical advantages. One important technical advantage is directionless mating of the connector plug with the connector jack. Because of the barrel or cylindrical shape of the connector plug and the location of the contacts within the connector jack, the connector plug does not have to be oriented in a particular manner in order to mate with the connector jack. A user can insert the connector plug into the connector jack without having to properly orientate the connector plug. Despite the orientation of the connector plug, the connector plug will be able to properly mate with the connector jack. Orientationless mating allows for a simplified operation of inserting the connector plug into the connector jack when the user does not have a clear line of sight to the connector jack or when the connector jack is difficult to reach.

Another important technical advantage of the present disclosure is the ability of the power connector assembly to handle a higher power level from the wall outlet and AC adapter. The outer, inner, and center bodies on the connector plug assembly and the outer, inner, and center contacts of the connector jack allow for the electrical current and power to be distributed across more than one contact point thereby allowing for the higher power levels of the power connector assembly. Using the outer, inner, and center bodies to transmit electrical current allows for more power to safely pass through the power connector assembly in comparison to previous power connectors where a single pin was responsible for the transmission of power and electrical current. Therefore, the power connector assembly is able to retain a size more suitable for portable functionality.

Another important technical advantage of the present disclosure is the ability to transmit a data signal in addition to an electrical current for power. The center body of the connector plug transmits a data signal having information regarding the type and operation of the AC adapter. The portable device uses the data signal to insure that a proper type of AC adapter is connected to the portable device and to insure that the AC adapter is functioning correctly.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 10, wherein like numbers are used to indicate like and corresponding parts.

Previous power connector assemblies have been designed so that a connector plug may only mate with a connector jack in a particular orientation. In addition, previous power connector assemblies have not been able to safely provide and transmit the necessary power required by today's power hungry computing and portable devices without increasing the electrical cord size or increasing the size of the power connector assembly. Furthermore, previous power connectors have not been able to effectively transmit a data signal in addition to the electrical current or power. The present disclosure allows for a power connector assembly including a connector plug and a connector jack operable to transmit higher levels of power as well as a data signal and where the connector plug mates with the connector jack independent of the orientation of the connector plug.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
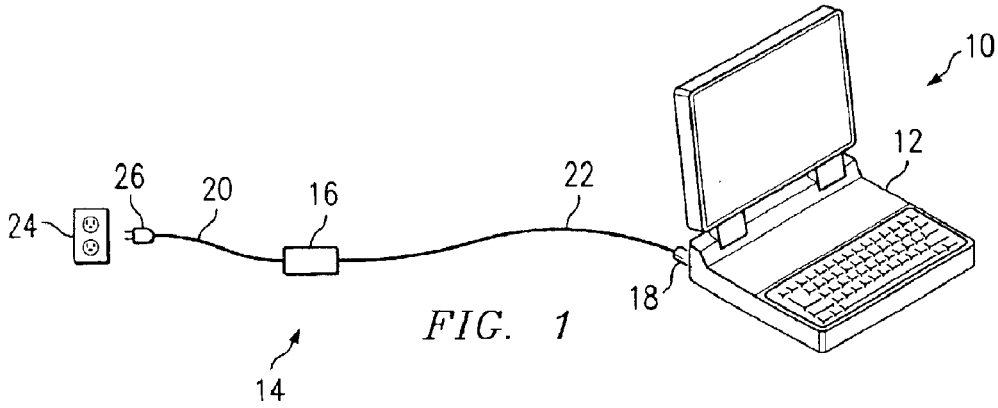
FIG. 1 is a schematic representation of an information handling system.
Figure 2:
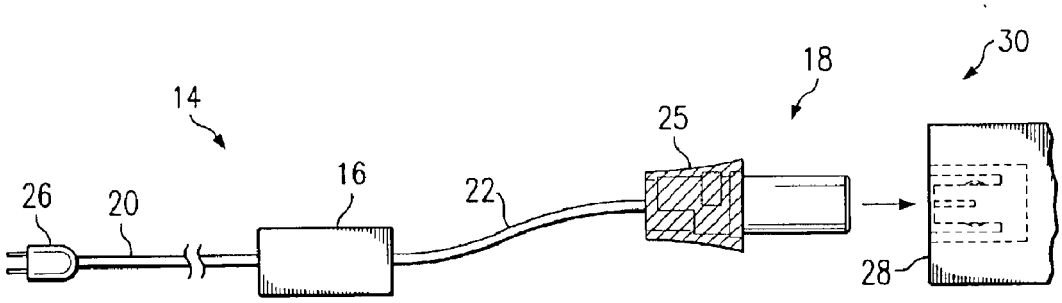
FIG. 2 is a schematic representation of a power connector assembly.

FIG. 1 is a schematic representation of information handling system 10 including computer 12 and power assembly 14. Power assembly 14 includes AC adapter 16, connector jack 18, power cord 20, and electrical cable 22. Power assembly 14 may also be referred to as an information handling system.

In the embodiment shown in FIG. 1, computer 12 may be any type of portable device such as a laptop or PDA that operates on battery power (DC power) but can also be plugged into electrical outlet 24 via AC adapter 16 to operator on power supplied by electrical outlet 24. Power assembly 14 couples with electrical outlet 24 and computer 12 to provide power to computer 12 via electrical plug 26 plugging into electrical outlet 24. This allows electrical current or power to flow from electrical outlet 24 through power cord 20 to AC adapter 16. AC adapter 16 receives the AC power signal from electrical outlet 24 and converts it into a DC power signal that can be used by computer 12. The DC power signal travels from AC adapter 16 along electrical cable 22 to connector plug 18 through connector jack 28 (shown in FIG. 2) to computer 12.

In addition to converting AC power to DC power, AC adapter 16 provides identification information regarding AC adapter 16. AC adapter 16 may be a high power level AC adapter, a low power level AC adapter, a travel-sized AC adapter, or any other appropriate type of AC adapter. Each different type of AC adapter has a unique ID specific to the type of adapter. For example, all high power level AC adapters have a specific ID while all travel-sized AC adapters have a different ID. AC adapter 16 transmit a data signal containing the identification information via electrical cable 22 through connector plug 18 and connector jack 28 to computer 12 so that computer 12 will know what type of AC adapter computer 12 is connected to. So in addition to a DC power signal, electrical cable 22 transmits a data signal to computer 12 via connector plug 18 and connector jack 28. The coupling or mating of connector plug 18 with connector jack 28 results in power connector assembly 30 which may also be referred to as an information handling system.

Figure 3A:
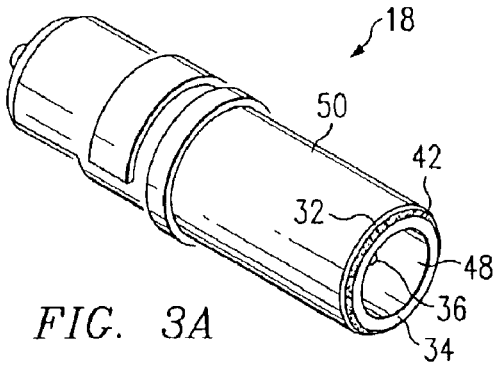
FIG. 3A depicts an isometric view of one embodiment of the connector plug assembly.
Figure 3B:
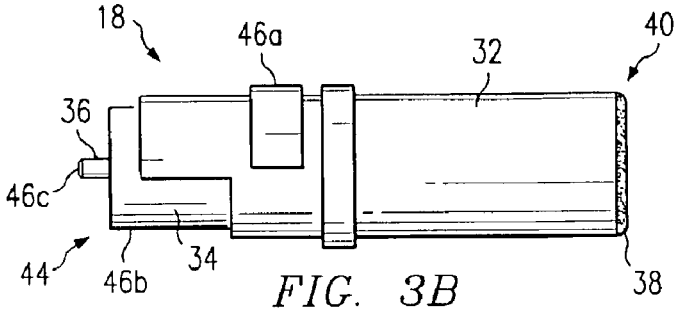
FIG. 3B illustrates a side view of one embodiment of the connector plug assembly.
Figure 3C:
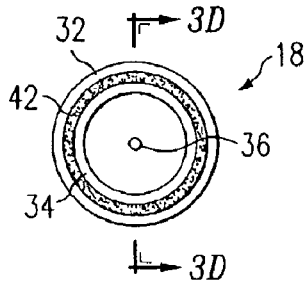
FIG. 3C depicts a front view of one embodiment of the connector plug assembly.
Figure 3D:
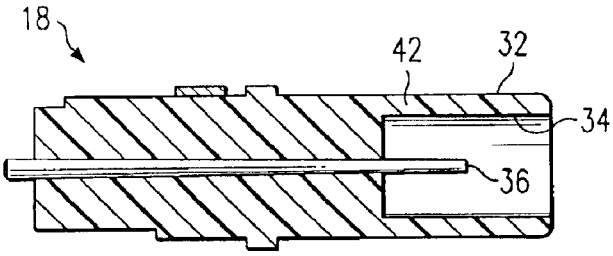
FIG. 3D illustrates a sectional view of one embodiment of the connector plug assembly.

FIGS. 3A, 3B, 3C, and 3D represent different views of one embodiment of connector plug 18 with overmold 25 removed to further show various aspects of connector plug 18. FIG. 3A depicts an isometric view of connector plug 18 (shown with insulating tip 38 removed), FIG. 3B illustrates a side view of connector plug 18, FIG. 3C depicts a front view of connector plug 18 (shown with insulating tip 38 removed), and FIG. 3D illustrates a sectional view of connector plug 18 taken along line 3D.

Connector plug 18 is used as part of power assembly 14 and power connector assembly 30 to provide DC power and a data signal to computer 12. Connector plug 18 is a barrel style DC power and data connector that couples with connector jack 28. Connector plug 18 includes three components allowing for three separate connections—an inner body and an outer body for power transmission and a center body for data transmission. The outer body, outer barrel 32, transmits a DC IN− electrical current. The inner body, inner barrel 34, transmits a DC IN+ electrical current. Outer barrel 32 and inner barrel 34 are composed of a base metal alloy such as brass or other suitable materials and have a contact surface plating of nickel or other suitable materials. The center body, center pin 36, transmits a data signal. Center pin 36 is composed of a base metal alloy such as nickel and has a contact surface plating of gold. In this embodiment, center pin 36 transmits a data signal that is an identification signal from AC adapter 16 to computer 12 which is used by computer 12 to identify the type of AC adapter 16 in power assembly 14. In alternate embodiments, center pin 36 may also transmit other data signals such as a television signal or a low power current allowing for a dual voltage supply for connector plug 18.

Connector plug 18 further includes two insulators—insulating tip 38 and insulating barrel 42. Insulating tip 38 is disposed proximate first end 40 of connector plug 18. Insulating tip 38 is composed of a dielectric material such as Polybutylene Terephthalate (PBT) or any other appropriate insulating material. Insulating tip 38 insulates first end 40 of connector plug 18 from connector jack 28 and prevents any electrical current run-off when connector plug 18 is coupled with connector jack 28. Connector plug 18 also includes insulating barrel 42. Insulating barrel 42 is disposed between outer barrel 32 and inner barrel 34. Insulating barrel 42 isolates outer barrel 32 from inner barrel 34 and prevents the electrical current transmitted in outer barrel 32 from coming into contact with the electrical current transmitted in inner barrel 34.

Connector plug 18 further includes overmold 25 which protects outer barrel 32, inner barrel 34, and center pin 36 from damage and protects a user from an electrical shock when inserting and removing connector plug 18 from connector jack 28. Overmold is disposed over second end 44 of connector plug 18. Overmold 25 is composed of an insulating material such as a dielectric material which includes Polyvinyl Chloride (PVC) or any other appropriate insulating material. Overmold 25 allows for a place for a user to grab and grip connector plug 18 to facilitate the insertion and removal of connector plug 18 into and out of connector jack 28.

In particular, overmold 25 provides protection where electrical cable 22 couples with outer barrel 32, inner barrel 34, and center pin 36 at second end 44 of connector plug 18. Electrical cable 22 is composed of at least three separate wires—two wires for power transmission and one wire for data transmission. The wires of electrical cable 22 couple with connector plug 18 at solder points 46*a*, 46*b*, and 46*c*. Solder point 46*a* is where outer barrel 32 couples with the DC IN− wire of electrical cable 22, solder point 46*b* is where inner barrel 34 couples with the DC IN+ wire of electrical cable 22, and solder point 46*c* is where center pin 36 couples with the data signal wire of electrical cable 22. The three wires of electrical cable 22 are soldered to connector plug 18 at solder points 46*a*, 46*b*, and 46*c*. When overmold 25 is in place over second end 44, a user of information handling system 10 will not be able to see solder points 46 and solder points 46 will be protected from damage by overmold 25.

The embodiment of connector plug 18 shown in FIGS. 3A, 3B, 3C, and 3D with insulating barrel 42 disposed between outer barrel 32 and inner barrel 34 and center pin 36 allows for connector plug 18 to have the largest contact surface in a minimized amount of space. The inner barrel and outer barrel design allows for contact surfaces on both inside surface 48 and outside surface 50 of connector plug 18 instead of just on outside surface 50. In addition, the inner barrel and outer barrel design allows for multiple contact points with connector jack 28 because both inner barrel 34 and outer barrel 32 have the entire circular surface of inner surface 48 and outer surface 50 to conduct electrical current and couple with the contacts in connector jack 28.

Furthermore, connector plug 18 has the advantage of being inexpensive and not difficult to manufacture because connector plug 18 requires no soldering to manufacture and connect outer barrel 32, inner barrel 34, and center pin 36. Outer barrel 32, inner barrel 34, and center pin 36 are machined and then press fit together with insulating barrel 42, insulating tip 38, and overmold 25. The only soldering required is the soldering of the three wires of electrical cable 22 to soldering points 46 of second end 44 of connector plug 18. Once electrical cable 22 is soldered to soldering points 46, overmold 25 fits over second end 44 and soldering points 46 as described above.

Figure 4A:
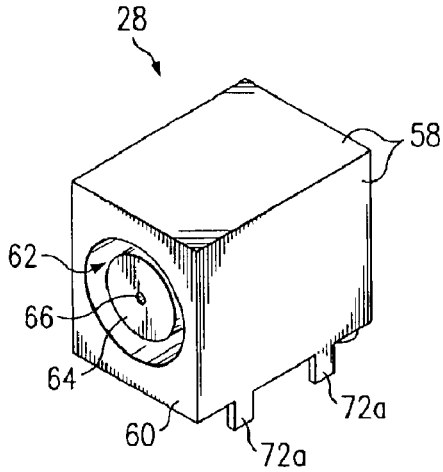
FIG. 4A depicts an isometric view of one embodiment of the connector jack assembly.
Figure 4B:
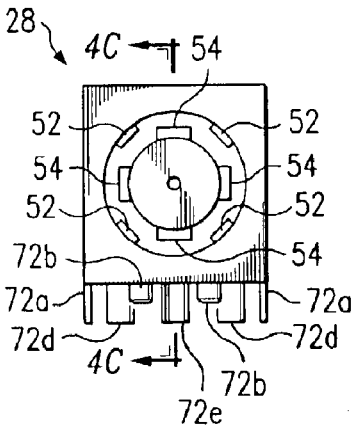
FIG. 4B illustrates a front view of one embodiment of the connector jack assembly.
Figure 4C:
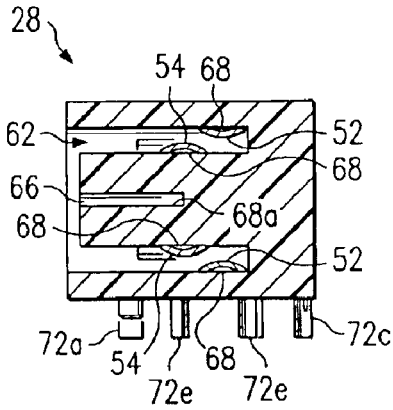
FIG. 4C depicts a sectional view of one embodiment of the connector jack assembly.

FIGS. 4A, 4B, and 4C represent different views of one embodiment of connector jack 28 operable to couple with connector plug 18. FIG. 4A depicts an isometric view of connector jack 28, FIG. 4B illustrates a front view of connector jack 28, and FIG. 4C depicts a sectional view of connector jack 28 taken along line 4C.

Connector jack 28 is a receptacle for connector plug 18 and operably couples with connector plug 18 to provide DC power and data signals to computer 12. Connector jack 28 includes three components for three separate connections—outer contacts 52 and inner contacts 54 for power transmission and center contact 56 for data signal transmission. Outer contacts 52 are operable to receive and transmit a DC IN− electrical current. Inner contacts 54 are operable to transmit and receive a DC IN+ electrical current. Center contact 56 receives and transmits a data signal. In this embodiment, center contact 56 receives and transmits a data signal that is an identification signal from AC adapter 16 to computer 12 which is used by computer 12 to identify the type of AC adapter 16 in power assembly 14. In alternate embodiments, center contact 56 may also receive and transmit other data signals such as a television signal or a low power current allowing for a dual voltage supply on the connector jack 28.

The embodiment of connector jack 28 shown in FIG. 4 includes four inner contacts 54 and four outer contacts 52. Inner contacts 54 couple with inner barrel 34 of connector plug 18 and outer contacts 52 couple with outer barrel 32 of connector plug 18. The coupling of outer contacts 52 with outer barrel 32 and inner contacts 54 with inner barrel 34 allows for a completed circuit and the transmission of DC power through power connector assembly 30. Having multiple contacts within connector jack 28 allows less current to go across each inner contact 54 and each outer contact 52 since the electrical current is broken up across four contacts for each electrical current signal. Each inner contact 54 and each outer contact 52 exhibits an inherent contact resistance and therefore contact resistance in connector jack 28 decreases because the four outer contacts 52 and the four inner contacts 54 essentially act as resistors in parallel.

Connector jack 28 further includes center contact 56 that couples with center pin 36 of connector plug 18 and allows for the transmission of a data signal from AC adapter 16 to computer 12. Outer contacts 52, inner contacts 54, and center contact 56 are composed of a base metal alloy such as a copper alloy or any other appropriate base metal alloy and include a surface plating or coating of silver or any other appropriate plating metal. In the embodiment shown in FIG. 4, connector jack 28 includes four outer contacts 52 and four inner contacts 54 but in alternate embodiments connector jack 28 may include more than four or less than four inner contacts 54 and outer contacts 56.

Connector jack 28 also includes connector housing 58 and connector body 60. Connector housing 58 is composed of a conducting material such as steel and has a tin plating finish. In addition to providing a housing body for connector jack 28, connector housing 58 also provides grounding for connector jack 28 from external electrical sources. For example, connector housing 58 provides a ground for connector jack 28 against any static electricity that may build up in computer 12 and therefore prevent an overload due to static electricity.

Connector body 60 is disposed within connector housing 58 and provides the coupling apparatus for connector plug 18 and connector jack 28. Connector body 60 is composed of an insulating material such as a dielectric material including Polyphenylene Sulphide (PPS). Disposed in connector body 60 is mating aperture 62 which allows for the coupling of connector plug 18 with connector jack 28. Connector body 60 further includes inner cylindrical body 64 disposed within mating aperture 62 and inner cylindrical body 64 includes center aperture 66 which receives and mates with center pin 36 of connector plug 18.

Connector body 60 of connector jack 28 also includes a plurality of contact apertures 68 disposed therethrough and thereout connector body 60. Outer contacts 52, inner contacts 54, and center contact 56 are each disposed and extend through contact apertures 68 so that the contacts 52, 54, and 56 may come into contact with inner outer barrel 32, inner barrel 34, and center pin 36 when connector plug 18 mates with connector jack 28. For example, center contact 56 is disposed through contact aperture 68*a* allowing for center contact 56 to press through the insulating material of connector body 60 and make contact with center pin 36 when connector plug 18 is mated with connector jack 28.

Connector jack 28 couples with printed circuit board (PCB) 70 which typically may be the motherboard of computer 12 or a daughtercard that has a cable assembly to the motherboard or other powered device. Connector jack 28 and PCB 70 include a specific layout of pin connectors 72 for coupling connector jack 28 and PCB 70 and for the transmission of electrical current and data signals from power connector assembly 30 to computer 12. Pin connectors 72 are soldered in the pattern of the layout on PCB 70 to allow for connector jack 28 to be securely attached to PCB 70 and computer 12 and to allow the electrical current signal and data signals from wall outlet 24 and AC adapter 16 to travel through connector plug 18 and connector jack 28 to computer 12. The soldered connections between connector jack 28 and PCB 70 allow for the transmission of power and data signals from power connector assembly 30 to computer 12.

Figure 5:
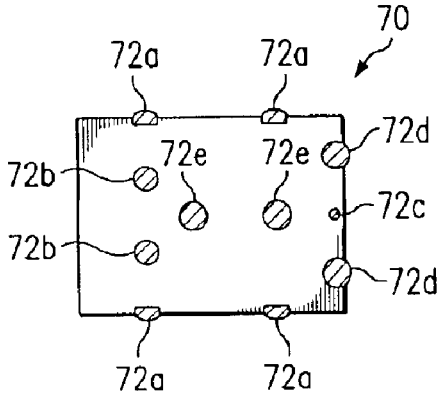
FIG. 5 illustrates a schematic representation of printed circuit board pin connector layout.

FIG. 5 illustrates a schematic representation of the layout of pin connectors 72 for PCB 70. The outer contacts 52, inner contacts 54, center contact 56, connector housing 58, and connector body 60 are coupled to one or more specific pin connectors 72 and correspond to a specific location on the layout of pin connectors 72 for PCB 70. For example, connector housing 58 has four ground pin connectors 72*a*, connector body 60 has two pin connectors 72*b*, outer contacts 52 have two outer pin connectors 72*e*, inner contacts 54 have two inner pin connectors 72*d*, and center contact 56 has one center pin connector 72*c*. Pin connectors 72 are shown in FIG. 4 and the corresponding location for each pin connector 72 on PCB 70 is shown in FIG. 5.

The layout of pin connectors 72 is in an arrangement to prevent a mouse bite. PCB's typically include a series of drilled holes in a line that allow a user to flex the PCB along the line of the drilled holes to break off a piece of the PCB. The line of drilled holes is what is known as a mouse bite. Pin connectors 72 are arranged so as to not create a mouse bite on PCB 70. Therefore, connector jack 28 is more firmly coupled to PCB 70 and there is less risk that connector jack 28 may break off of PCB 70 when a momentary force or a torque is applied to connector jack 28. In alternate embodiments, the number of pin connectors 72 and the layout of pin connectors 72 on PCB 70 may be different while still minimizing the potential for mouse bite breakage and allowing for the transmission of electrical current and data signals from power connector assembly 30 to computer 12.

Figure 6:
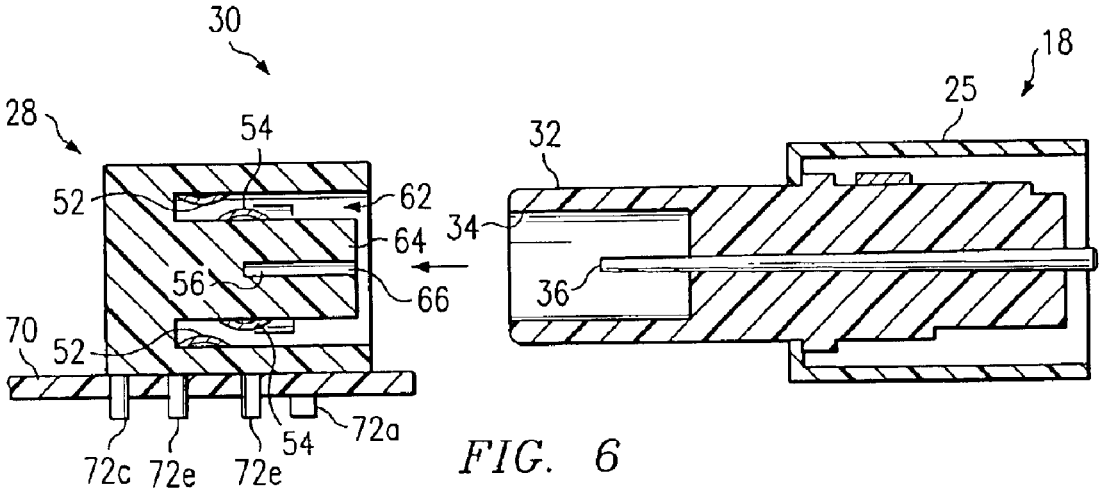
FIG. 6 depicts an exploded sectional view of one embodiment of the power connector assembly.

FIG. 6 depicts an exploded sectional view of one embodiment of power connector assembly 30. FIG. 6 illustrates in greater detail the coupling of connector plug 18 with connector jack 28.

Connector plug 18 mates with connector jack 28 when a user inserts connector plug 18 into mating aperture 62. When connector plug 18 and connector jack 28 are coupled together, connector plug 18 is disposed within connector jack 28, inner cylindrical body 64 is disposed within inner barrel 34, and center pin 36 is disposed in center aperture 66. This allows for outer barrel 32 to be in contact with outer contacts 52, inner barrel 34 to be in contact with inner contacts 54, and center pin 36 to be in contact with center contact 56 resulting in the transmission of electrical current and data signals from wall outlet 24 and AC adapter 16 via power connector assembly 30 to computer 12.

The shape of connector plug 18 allows for the orientationless coupling of connector plug 18 and connector jack 28 as well as the greatest contact surface area in the smallest possible volume of space. Since first end 40 of connector plug 18 is circular and symmetrical in shape, connector plug 18 does not need to be in a particular orientation to couple and mate with connector jack 28. The barrel or cylindrical shape of connector plug 18 allows a user to insert connector plug 18 into connector jack 28 despite the orientation of connector plug 18 because the shape of connector plug 18 for mating is the same regardless of the orientation of connector plug 18. Mating aperture 62 is also circular and symmetrical in shape so that it can receive connector plug 18 in any orientation. Therefore, the task of inserting connector plug 18 into connector jack 28 when a user may not have a clear line of sight to connector jack 28 is made simpler because the user does not have to worry about making sure connector plug 18 and connector jack 28 are property aligned and in the correct orientation. And using both outer surface 50 and inner surface 48 of connector plug 18 to conduct electrical current from connector plug 18 to connector jack 28 allows for connector plug 18 to be shorter in length than if the contact points for connector plug 18 were all on outer surface 50 instead of being both on outer surface 50 and inner surface 48.

Additionally, the shape of connector plug 18 and connector jack 28 is specifically different from and incompatible with previous power connector assemblies for safety and efficiency reasons and to prevent user confusion. For example, previous connector plugs and jacks have had a "D" shape while connector plug 18 has a circular shape. This incompatibility is important since connector plug 18 and connector jack 28 can handle higher power levels than previous power connector assemblies. If a user tried to plug power assembly 14 into a laptop computer not designed to mate with power assembly 14, the laptop computer may potentially draw more power than a power supply can produce resulting in the power supply failing. But typical laptop computers and AC adapters do not draw more power than can be supplied by a power supply, such as wall outlet 24. Therefore, the laptop computer would not draw more than it requires if connected to power assembly 14 but AC adapter 16, rated for a higher power level, would be operating less efficiently and needlessly wasting power. Therefore, the shape of connector plug 18 is incompatible with previous connector jacks to prevent potential failures and inefficient operation of AC adapter 16.

In addition, user confusion is reduced because a user of information handling system 10 can clearly tell whether or not power assembly 14 including connector plug 18 mate with a device based on the shape of the corresponding connector jack for the specific device. If connector plug 18 and connector jack 28 were not incompatible with previous designs than a user may be confused as to why a device does not function properly when the device is connected to electrical outlet 24 but an incompatible power assembly 14 is used. The incompatibility protects previous models of computer 12 and prevents users from trying to use their old AC adapters and connector plugs with newer models of computers 12.

Power connector assembly 30 handles a higher power level than previous power connectors. Previous power connectors typically handle up to 70 Watts of power while power connector assembly 30 handles up to 120 Watts of power. The higher power levels of power connector assembly 30 is due to the distribution of electrical current across multiple inner contacts 54 and multiple outer contacts 52 from inner barrel 34 and outer barrel 32 as described above. In addition, the multiple contacts 52 and 54 allows for a decrease in the amount of loss across inner contacts 54 and outer contacts 52 and therefore a higher power level.

Figure 7A:
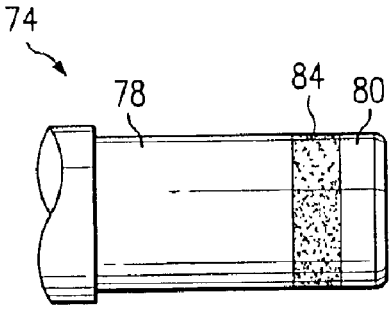
FIG. 7A is a schematic representation of an alternate embodiment of the connector plug assembly.
Figure 7B:
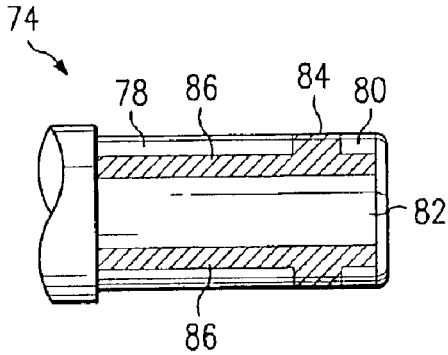
FIG. 7B depicts a sectional view of the connector plug assembly of FIG. 7A.
Figure 8:
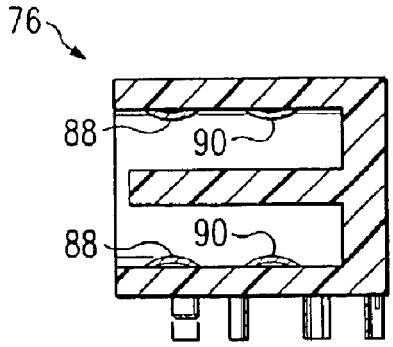
FIG. 8 illustrates a sectional view of an alternate embodiment of the connector jack assembly.

Referring to FIGS. 7 and 8, an alternate embodiment of the present disclosure is shown. FIG. 7A is a schematic representation of an alternate embodiment of connector plug 74, FIG. 7B depicts a sectional view of connector plug 74 of FIG. 7A, and FIG. 8 illustrates a sectional view of an alternate embodiment of connector jack 76 operable to couple with connector plug 74.

Connector plug 74 includes three bodies—inner body 78, outer body 80, and center body or center barrel 82. Disposed between inner body 78 and outer body 80 is insulating barrel 84 and disposed between inner body 78 and outer body 80 and center barrel 82 is insulating center barrel 86. Both insulating barrel 84 and insulating center barrel 86 are composed of a dielectric material such as PVC, PBT, or any other appropriate insulating material. As with connector plug 18, connector plug 74 is operable to transmit both electrical current and a data signal to connector jack 76.

Connector jack 76 couples with connector plug 74 and has a similar connector housing structure, contact apertures, and pin connectors as connector jack 28. Connector jack 76 includes inner contacts 88, outer contacts 90, and center contract pin 92. The outer surface of inner barrel 78 is in contact with inner contacts 88, the outer surface of outer barrel 80 is in contact with outer contacts 90, and center barrel 82 is in contact with center pin contact 92. Since connector plug 74 has center barrel 82 as a center body instead of a center pin as with connector plug 18, connector jack 76 requires a center contact pin 92 to couple with center barrel 82.

The embodiment shown in FIGS. 7 and 8 allows for a smaller connector plug 74 size when compared to the size of connector plug 18 due to there being no center pin in connector plug 74. In order to transmit the data signal, center pin 36 of connector plug 18 has to be a particular size. Since connector plug 74 has no center pin, the overall size of connector plug 74 may be decreased. The smaller size of connector plug 74 allows connector plug 74 and connector jack 76 to be suited for devices requiring an ultra-mobile operation where space and weight is a great concern. But the smaller size also results in the ability to handle lower power levels than those of power connector assembly 30. And as with power connector assembly 30, the circular and symmetrical design of connector plug 74 allows for the coupling of connector plug 74 with connector jack 76 independent of the orientation of connector plug 74.

Figure 9A:
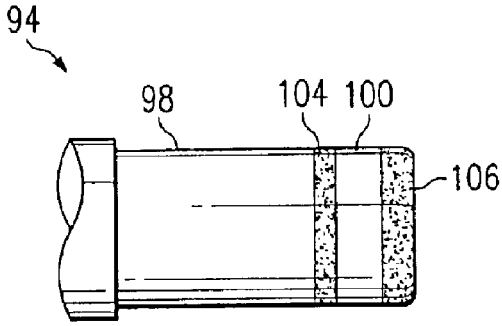
FIG. 9A represents a schematic view of an alternate embodiment of the connector plug assembly.
Figure 9B:
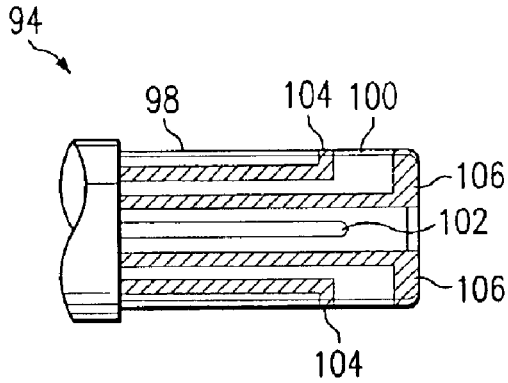
FIG. 9B illustrates a sectional view of the connector plug assembly of FIG. 9A.
Figure 10A:
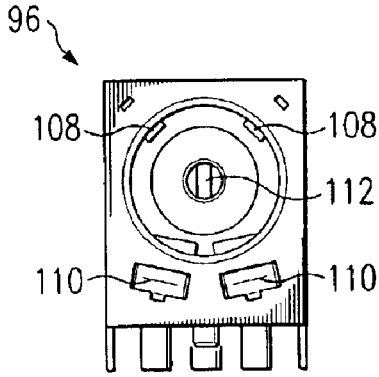
FIG. 10A is a schematic representation of an alternate embodiment of the connector jack assembly.
Figure 10B:
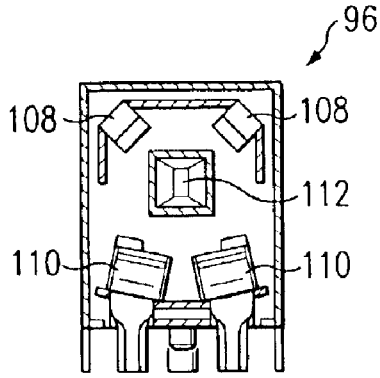
FIG. 10B is a sectional view of the connector jack assembly of FIG. 10A.

Referring to FIGS. 9 and 10, an alternate embodiment of the present disclosure is shown. FIG. 9A represents a schematic view of an alternate embodiment of connector plug 94, FIG. 9B illustrates a sectional view of connector plug 94 of FIG. 9A, FIG. 10A is a schematic representation of an alternate embodiment of connector jack 96 operable to couple with connector plug 94, and FIG. 10B is a sectional view of connector jack 96 of FIG. 10A.

Connector plug 94 includes three bodies—outer body 98, inner body 100, and center body or center pin 102. Disposed between outer body 98 and inner body 100 is insulator 104 which prevents electrical current from flowing between outer body 98 and inner body 100. Disposed between inner body 100 and center pin 102 is insulating barrel tip 106 which is composed of an insulating barrel that forms into an insulating tip which provides insulation between connector plug 94 and connector jack 96. As with connector plug 18, connector plug 94 is operable to transmit both electrical current and a data signal to connector jack 96.

Connector jack 96 couples with connector plug 94 and has a similar connector housing structure, contact apertures, and pin connectors as connector jack 28. Connector jack 94 includes two outer contacts 108, two inner contacts 110, and center contract 112. The outer surface of inner barrel 100 is in contact with inner contacts 110, the outer surface of outer barrel 98 is in contact with outer contacts 108, and center pin 102 is in contact with center contact 112. As with connector jack 28, outer barrel 98 and inner barrel 100 transmit the electrical current while center pin 102 transmits a data signal. Having only two outer contacts 108 and two inner contacts 110 instead of four as in connector jack 28 allows for cheaper manufacturing costs but at a price of not being able to handle a power level as high as the power levels of connector jack 28.

The embodiment shown in FIGS. 9 and 10 has the same orientationless benefits of power connector assembly 30. Because of the circular and symmetrical shape of connector plug 94, connector plug 94 couples with connector jack 96 independent of the orientation of connector plug 94.

Although the disclosed embodiments have been described in detail, it should be understood that various changes, substitutions and alterations can be made to the embodiments without departing from their spirit and scope.

What is claimed is:

1. An orientationless connector plug assembly comprising:

an outer body having an outer barrel cylindrical shape operable to transmit an electrical current;

an inner body having an inner barrel cylindrical shape and secured coaxially and in alignment with the outer body, the inner body operable to transmit an electrical current;

a center body comprising a center barrel disposed coaxially within the outer body and the inner body, the center body operable to transmit a data signal;

one or more insulators disposed coaxially with the outer body, the inner body, and the center body, the one or more insulators operable to prevent the transmission of an electrical current and a data signal between the outer body, the inner body, and the center body; and wherein the connector plug assembly is operable to couple with a connector jack assembly independent of the orientation of the connector plug assembly in relation to the orientation of the connector jack assembly.

2. The connector plug assembly of claim 1 wherein the center body comprises a center pin.

3. The connector plug assembly of claim 1 wherein the data transmitted by the center body comprises identification information.

4. The connector plug assembly of claim 1 wherein one of the insulators comprises an insulating barrel disposed between the outer body and the inner body, the insulating barrel operable to isolate the outer body from the inner body to prevent electrical contact between the outer body and the inner body.

5. The connector plug assembly of claim 1 further comprising an overmold disposed proximate a second end of the connector jack assembly and operably coupled to an electrical cable.

6. The connector plug assembly of claim 1 further comprising the outer body, the inner body, and the center body each operably coupled to an electrical cable.

7. The connector plug assembly of claim 1 wherein the center body is further operable to transmit a low power current.

8. An orientationless connector plug assembly comprising:

an outer body having an outer barrel cylindrical shape operable to transmit an electrical current;

an inner body having an inner barrel cylindrical shape and secured coaxially and in alignment with the outer body, the inner body operable to transmit an electrical current;

a center body comprising a center barrel disposed coaxially within the outer body and the inner body, the center body operable to transmit a data signal;

one or more insulators disposed coaxially with the outer body, the inner body, and the center body, the one or more insulators operable to prevent the transmission of an electrical current and a data signal between the outer body, the inner body, and the center body;

wherein the connector plug assembly is operable to couple with a connector jack assembly independent of the orientation of the connector plug assembly in relation to the orientation of the connector jack assembly; and wherein one of the insulators comprises an insulating center barrel disposed between the outer and inner bodies and the center barrel, the insulating center barrel operable to prevent electrical contact between the outer and inner bodies and the center barrel.

9. An orientationless connector plug assembly comprising:

an outer body having an outer barrel cylindrical shape operable to transmit an electrical current;

an inner body having an inner barrel cylindrical shape and secured coaxially and in alignment with the outer body, the inner body operable to transmit an electrical current;

a center body comprising a center barrel disposed coaxially within the outer body and the inner body, the center body operable to transmit a data signal;

one or more insulators disposed coaxially with the outer body, the inner body, and the center body, the one or more insulators operable to prevent the transmission of an electrical current and a data signal between the outer body, the inner body, and the center body; and wherein the connector plug assembly is operable to couple with a connector jack assembly independent of the orientation of the connector plug assembly in relation to the orientation of the connector jack assembly; and wherein one of the insulators comprises an insulating tip disposed proximate a first end of the connector plug assembly, the insulating tip operable to insulate the connector plug assembly from the connector jack assembly.

10. An orientationless connector jack assembly comprising: a connector housing operable to provide grounding for the connector jack assembly;

a connector body disposed within the connector housing and having a shape operable for mating with a connector plug assembly, the connector body including a mating aperture and a plurality of contact apertures and operable to provide insulation;

at least one inner contact disposed in at least one of the contact apertures and extending into the mating aperture, the inner contact operable to receive and transmit an electrical current;

at least one outer contact disposed in at least one of the contact apertures and extending into the mating aperture, the outer contact protruding operable to receive and transmit an electrical current;

a center contact disposed within one of the contact apertures and extending into the mating aperture, the center contact operable to receive and transmit a data signal; and wherein the connector jack assembly is operable to couple with the connector plug assembly independent of the orientation of the connector plug assembly.

11. The connector jack assembly of claim 10 wherein the connector body includes:

an inner cylindrical body operable to couple with an inner body of the connector plug assembly; and a center aperture operable to receive a center pin thereby allowing the center pin to operably couple with the center contact.

12. The connector jack assembly of claim 10 wherein the center contact comprises a center contact pin operable to couple with a center barrel.

13. The connector jack assembly of claim 10 further comprising a printed circuit board including a pin connector layout and a plurality of pin connectors, the printed circuit board operably coupled to the connector jack assembly.

14. The connector jack assembly of claim 13 wherein the pin connectors include at least one center pin connector coupled to the printed circuit board and the center contact.

15. The connector jack assembly of claim 13 wherein the pin connectors include at least one outer pin connector coupled to the printed circuit board and the outer contacts.

16. The connector jack assembly of claim 13 wherein the pin connectors include at least one inner pin connector coupled to the printed circuit board and the inner contacts.

17. The connector jack assembly of claim 13 wherein the pin connectors include at least one ground pin connector coupled to the printed circuit board and the connector housing.

* * * * *